US007690659B2

(12) United States Patent
Wilt

(10) Patent No.: US 7,690,659 B2
(45) Date of Patent: Apr. 6, 2010

(54) MULTI-DIRECTIONAL ROLLER DISC

(76) Inventor: Robert Wilt, 10075 Windstream Dr., Columbia, MD (US) 21044

( * ) Notice: Subject to any disclaimer, the term of this patent is extended or adjusted under 35 U.S.C. 154(b) by 1050 days.

(21) Appl. No.: 11/384,674

(22) Filed: Mar. 20, 2006

(65) Prior Publication Data

US 2006/0207839 A1 Sep. 21, 2006

Related U.S. Application Data

(60) Provisional application No. 60/714,534, filed on Mar. 18, 2005.

(51) Int. Cl.
*B62M 1/04* (2006.01)

(52) U.S. Cl. ..... 280/87.042; 280/8; 280/221; 188/4 R

(58) Field of Classification Search ..... 188/4 R; 280/87.042, 218, 842, 8, 221
See application file for complete search history.

(56) References Cited

U.S. PATENT DOCUMENTS 3,310,320 A * 3/1967 Hanna et al. ..... 280/87.042
3,438,642 A * 4/1969 Puleo et al. ..... 280/8
4,181,319 A * 1/1980 Hirbod ..... 280/221
4,621,825 A * 11/1986 Lee ..... 280/218
2006/0049595 A1* 3/2006 Crigler et al. ..... 280/87.042

* cited by examiner

*Primary Examiner*—Christopher P Schwartz
(74) *Attorney, Agent, or Firm*—Ober / Kaler; Royal W. Craig

(57) ABSTRACT

A motor-driven roller disc for multi-directional operation under the control of a user, with a multi-wheeled drive configuration with motorized direct-drive power-train to give a user the ability to move in any direction at any time, and to maintain control over steering and speed when in motion. The roller disc includes a platform having an array of radially-oriented wheels mounted around the underside perimeter, and a central pivot wheel mounted at the center of the underside. The central pivot wheel maintains a slightly higher clearance than the perimeter wheels, enabling the user to engage a desired perimeter wheel by shifting his/her weight towards it, thereby making contact with the ground. All of the perimeter wheels are connected to a common flexible/jointed axle that encircles the disc, the axle being driven by a battery-powered DC motor. The user controls the speed of the motor by a remote hand-controller such as an RF remote control, and maintains control over direction by shifting his weight about the pivot wheel to achieve traction with a desired perimeter wheel thereby allowing motion in that direction.

19 Claims, 2 Drawing Sheets

MULTI-DIRECTIONAL ROLLER DISC

CROSS-REFERENCE TO RELATED APPLICATIONS

The present application derives priority from U.S. Provisional Patent Application No. 60/714,534, filed: Mar. 18, 2005.

BACKGROUND OF THE INVENTION

1. Field of the Invention

The present invention relates to motorized sports boards, and more particularly, to a roller disc for multi-directional operation under the control of the user.

2. Description of the Background

Skateboarding has a rich history of innovation dating back to the early 1900's. Early skateboards were home-built contraptions with roller skates for wheels attached to a two by four, and a milk crate nailed to it with handles sticking out for control. In the 1950s commercial skateboards began to appear, and skateboarding gained a following through the 1960s. The Makaha Company designed the first professional boards in 1963 and launched a team to promote the product. Skateboards became popular in the mid-1960s as contests were organized, movies (Skater Dater) were produced, and magazines (The Quarterly Skateboarder) were published. In the 1970s urethane wheels were developed and gained a strong following. The resulting boom in the industry led quickly to many new products and ideas.

For example, U.S. Pat. No. 4,621,825 to Lee issued Nov. 11, 1986 shows an oscillating skateboard that enables the user to stand on the platform and shift his weight thereon to effect the forward motion of the skate board.

U.S. Pat. No. 5,673,941 discloses a roller ski board having a plurality of wheel pairs pivotally mounted under the board body. The wheel pairs result in an arcuate contact with the ground to achieve edging effects similar to an ordinary snow ski board.

More recently, motorized skateboards have become increasingly popular. For example, U.S. Pat. No. 6,007,074 to Tarng issued Dec. 28, 1999 shows a frictionless noncontact engaging drive skate and skateboard with a synchronous differential driving mechanism. With the manipulation of a sole or heel, the skate or skateboard can skate forward and backward, accelerate, decelerate, free-run, brake, turn right and left.

The basic skateboard design has evolved into various other motorized configurations. U.S. Pat. 6,651,766 to Kamen issued Nov. 25, 2003 is one of his many patents for the Segway®.

While the foregoing devices are admirable, their use of wheels inevitably sacrifice control over lateral movement. Four wheels go in one direction: forward, with only a gradual ability to turn.

It would be greatly advantageous to provide a multi-wheeled roller disc with motorized direct-drive power-train to give a user the ability to move in any direction at any time, and to maintain control over steering and speed when in motion.

SUMMARY OF THE INVENTION

It is, therefore, an object of the present invention to provide a roller disc for multi-directional operation under the control of the user, with a multi-wheeled drive configuration with motorized direct-drive power-train to give a user the ability to move in any direction at any time, and to maintain control over steering and speed when in motion.

It is still another object to provide a motor-driven roller disc for multi-directional operation as described above with direction control by simple weight-shift, and with optional speed control in the form of remote (RF) speed controller or remote hard-wired speed controller.

In accordance with the above-described and other objects, the present invention provides a motor-driven roller disc for multi-directional operation under the control of the user, with a multi-wheeled drive configuration with motorized direct-drive power-train to give a user the ability to move in any direction at any time, and to maintain control over steering and speed when in motion. The roller disc includes a platform having an array of radially-oriented wheels mounted around the underside perimeter, and a central pivot wheel mounted at the center of the underside. The central pivot wheel maintains a slightly higher clearance than the perimeter wheels, enabling the user to engage a desired perimeter wheel by shifting his/her weight towards it, thereby making contact with the ground. All of the perimeter wheels are connected to a common flexible (or jointed) axle that encircles the disc, and one of the perimeter wheels is driven by a battery-powered DC motor connected to said wheel by a drive belt, which causes all perimeter wheels to rotate in unison. The user controls the speed of the motor by a remote hand-controller such as an RF remote control, or hard-wired remote control. The foregoing multi-wheeled drive configuration with motorized direct-drive power-train gives the user the ability to move in any direction at any time by simple weight-shift, and to maintain control over steering and speed when in motion via the hand-controller.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The present invention is a motor-driven roller disc 2 for multi-directional operation under the control of a user, with a multi-wheeled drive configuration having a motorized direct-drive power-train to give a user the ability to move in any direction at any time, and to maintain control over steering and speed when in motion.

Figure 1:
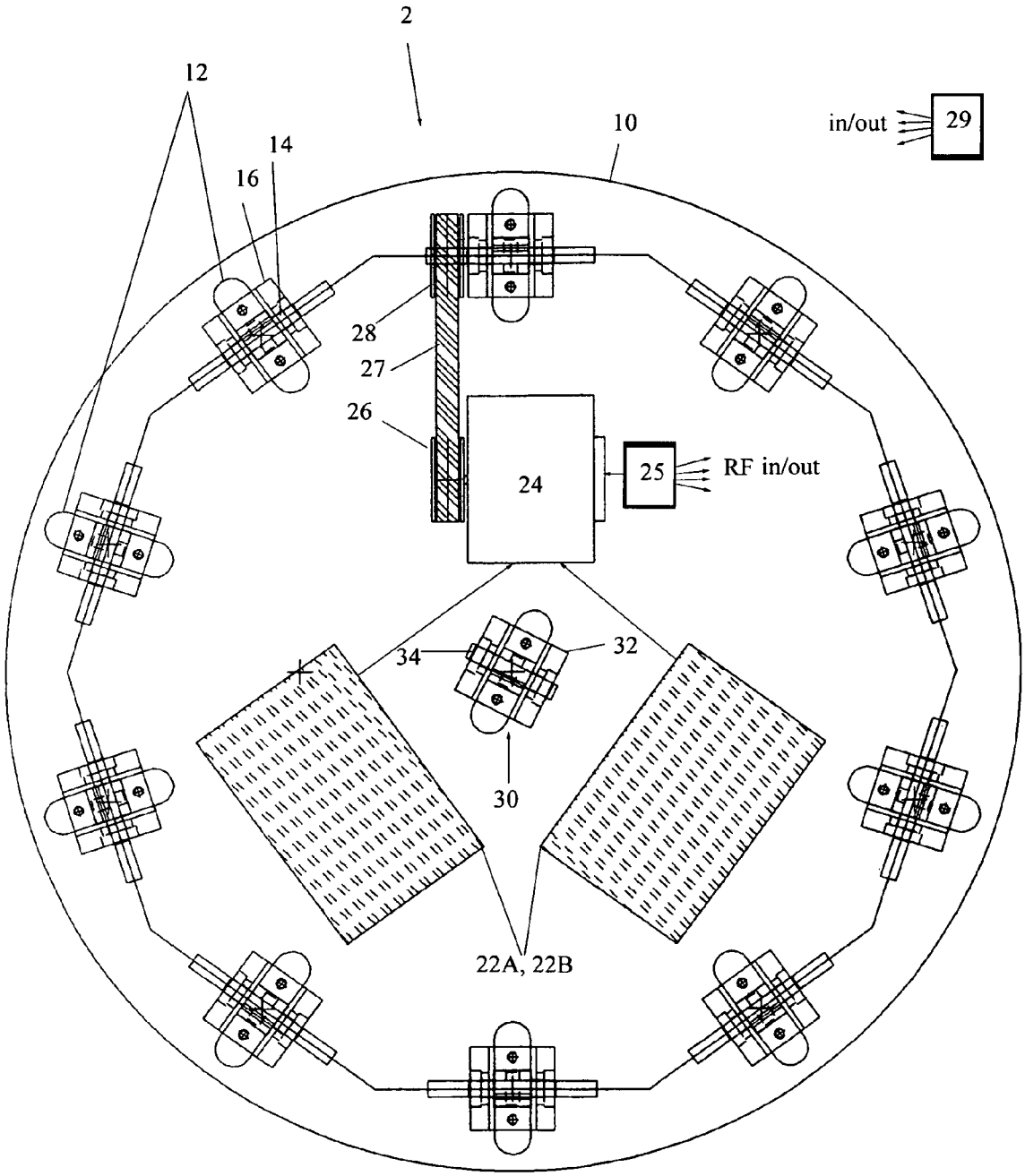
FIG. 1 is a bottom perspective view of the motor-driven roller disc 2 according to the present invention.

FIG. 1 is a bottom perspective view of the motor-driven roller disc 2 according to the present invention. The roller disc 2 generally includes a platform 10 formed from wood, plywood, fiberglass, aluminum, carbon fiber, or the like. An array of radially-oriented wheels 12 are mounted around the underside perimeter of the platform 10. Each perimeter wheel 12 preferably comprises a urethane roller mounted on a metal or plastic hub. The hub/wheel combination is fixedly-mounted on a short axle segment 14 that is carried at its distal ends in a stationery yoke 16 that is screwed or otherwise secured to the underside of platform 10. The yokes 16 each comprise a simple two-flange mounting that may be machined from aluminum or other rigid material, with holes through each flange to pass the axle segment 14. The axle segments 14 are preferably mounted to the yokes 16 by conventional bushings, bearing plates, or balls/rollers for low-friction turning. In the illustrated embodiment, the axle segments 14 are hollow tubular segments, and a 360 degree flexible (or jointed) axle 18 passes through each of the axle segments 14 in a circular configuration (and through each yoke 16 as well). The flexible/jointed axle 18 may be a series of rigid axle segments coupled together at universal joints, or alternatively, a unitary spring-axle, or any other type of known flexible/jointed axle. The flexible/jointed axle 18 is fixedly secured within each axle segment 14 (or in the case of a continuous spring, compression fit there through) to effect concurrent turning of the perimeter wheels 12 under power of a motor-drive assembly, and with very low backlash. The motor-drive assembly includes one or two battery packs 22A & 22B that are preferably commercially-available rechargeable lithium ion battery packs, such as dual 12VDC, 12AH Battery packs for electric scooters, connected in parallel, and mounted directly to the underside of platform 10 (these could alternatively be 2×24VDC connected in series). There may be individual housings provided for allowing removal and replacement of the battery packs 22A & 22B. The battery packs 22A & 22B are electrically connected to a conventional brushless high-torque DC motor 24, such as a 500 w, 24VDC, 24 amp Electric Motor for scooters. The DC Motor 24 is equipped with a pulley 26 (or toothed puller or sprocket), which turns one end of a drive belt 27, the other end of drive belt 27 being mounted around another pulley 28 that is mounted on the end of an axle segment 14 external to its yoke 16. Thus, the DC Motor 24 selectively turns the pulley 26, which turns drive belt 27, which turns the pulley 28, axle segment 14, and the wheel hub combination. Moreover, this turns the flexible/jointed axle 18, which rotates all of the perimeter wheels 12 in unison. The speed of the DC Motor 24 is controlled by an on-board motor controller 25, which in turn is operated by a hand-held remote control paddle 29 carried by the user. The hand held remote control paddle 29 may be any form of remote, inclusive of a hard-wired remote control, but is preferably a radio frequency (RF) transceiver in communication with a like (RF) transceiver connected to on-board motor controller 25. The two RF transceivers maintain open communication so that a user standing on the disc 2 and carrying the hand-held remote control paddle 29 in one hand can easily speed, slow or cease the rotation speed of motor 24 whilst operating the disc 2. A central pivot wheel 30 is also mounted at the center of the underside of platform 10. The central pivot wheel 30 preferably comprises a urethane roller mounted on a metal or plastic hub. The hub/wheel combination is fixedly-mounted on a short axle segment 34 that is carried at its distal ends in a pivoting yoke 32. Pivoting yoke 32 is rotatably secured to the underside of platform 10 at the center, preferably on a bearing plate or bushing for free rotation, and is thereby able to pivot into immediate alignment with the direction of travel of the disc 2. The pivoting yoke 32 is likewise a simple two-flange (or forked) mounting that may be machined from aluminum or other sturdy material, with holes through each flange to pass the axle segment 34. The axle segments 34 are preferably mounted to the yoke 32 by conventional bushings or bearing plates for low-friction turning. In accordance with the present invention, it is necessary to maintain a slightly higher clearance at the pivoting wheel 30 than at the perimeter wheels 12, so that the pivoting wheel 30 acts as a fulcrum. The user generally balances on the center of platform 10 which maintains weight on the pivoting wheel 30, yet the user is free to engage a desired perimeter wheel 12 by shifting his/her weight towards it, thereby making contact with the ground. This selective shifting determines the direction of travel, which may be adjusted or readjusted by simple weight shifts. Thus, the user maintains control over direction by weight shift, and further controls the speed of the motor by remote hand-controller 29.

In the preferred embodiment there are ten perimeter wheels 12 evenly-spaced around the periphery and radially-oriented from the center at 36 degree offsets. This number may change as a matter of design choice. One perimeter wheel 12 is coupled to the DC Motor for direct drive operation of all the perimeter wheels 12 via flexible/jointed axle 18. In this configuration and using a multi-segment rigid flexible/jointed axle 18, there will be ten axle 18 segments joined between the wheels 12 by universal joints. One skilled in the art will understand that a lesser or greater number of perimeter wheels 12 may be employed as a matter of design choice. It is also possible to replace the RF controller 29 with a hard-wired controller, or with an alternate wireless communication remote such as Bluetooth or the like.

Figure 2:
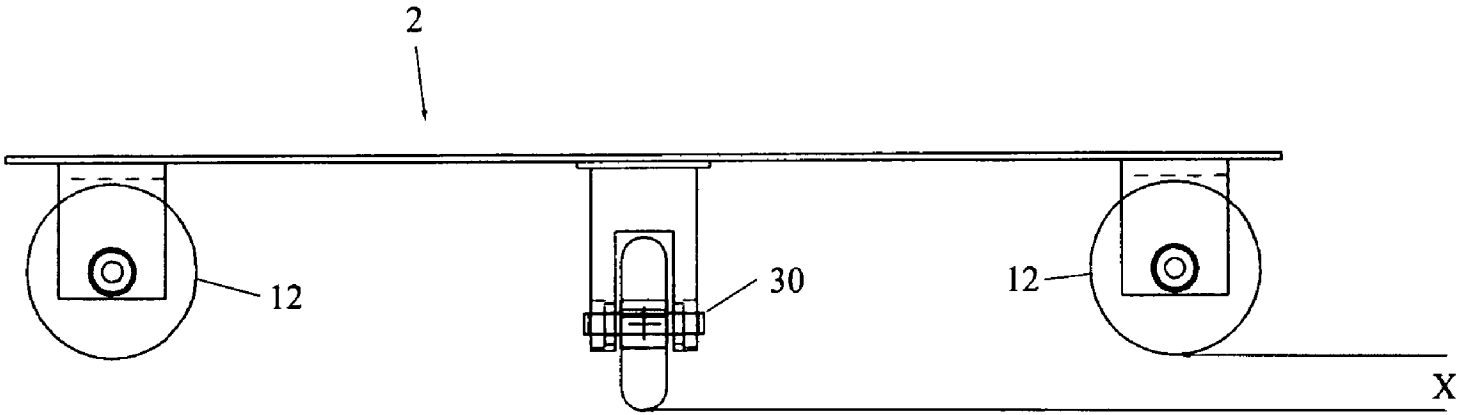
FIG. 2 is a side perspective view of the motor-driven roller disc 2 as in FIG. 1.
Figure 3:
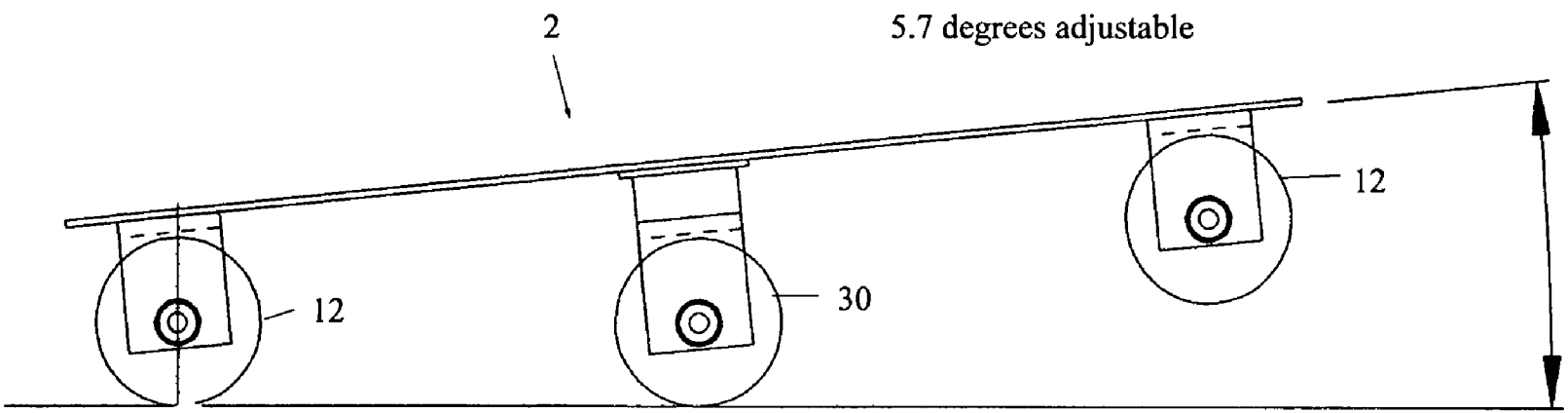
FIG. 3 is a side cross-section of the motor-driven roller disc 2 as in FIGS. 1 and 2 in a tilted orientation to show engagement of a perimeter wheel.

FIG. 2 is a side perspective view of the motor-driven roller disc 2 as in FIG. 1 illustrating the slightly higher clearance at the pivoting wheel 30 than at the perimeter wheels 12, so that the pivoting wheel 30 acts as a fulcrum. The additional clearance X may vary depending on the size of the overall disc 2, as well as other variables such as hill incline and bump compensation. Notwithstanding, as shown in FIG. 3 the clearance X should be sufficient to permit a tilt within a range of from 2 degrees to 8 degrees, and most preferably a 5.3 degree tilt. This strikes an appropriate balance in the effort needed to engage the perimeter wheels 12, and yet avoid unintentional engagement for relatively flat surfaces. Thus, as seen in FIG. 3, shifting the weight about the pivot wheel 30 to achieve traction with a desired perimeter wheel 12 will allow motion in that direction.

In using the multi-directional disc 2, the user grips the remote controller 29 with hand and steps aboard, generally balancing on the center of platform 10 and maintains his/her balance over the pivoting wheel 30. The user then engages a desired perimeter wheel 12 by shifting his/her weight towards it, thereby making contact with the ground. The motor 24 is accelerated by the hand controller 29, and the user is propelled in the direction of the selected perimeter wheel 12 by that wheel itself. However, selective shifting during travel allows the user to turn gradually or quite instantaneously to an alternate direction of travel, which may be adjusted or readjusted by simple weight shifts, thereby engaging other perimeter wheels 12. Thus, the user maintains constant control over direction by weight shift, and constant control over the speed of the motor by remote hand-controller 29.

In an alternative and more basic embodiment, the device is non-powered for use like a skateboard. As before, there is a pivoting wheel 30 that protrudes farther than perimeter wheels 12, so that the pivoting wheel 30 acts as a fulcrum. Ten perimeter wheels 12 are evenly-spaced around the periphery and radially-oriented from the center at 36 degree offsets. However, there is no DC Motor nor any connection of the perimeter wheels 12 via flexible/jointed axle 18. There also is no controller 29. The device is urged manually forward (in any direction) and directional changes are effected by tilting in that direction. Thus, shifting the weight to achieve the tilted orientation in a user-determined direction will engage the proximate perimeter wheel 12 and allow motion in that direction. A tilt within a range of from 2 degrees to 8 degrees, and most preferably a 5.3 degree tilt shall again suffice.

Having now fully set forth the preferred embodiment and the concept underlying the present invention, various other embodiments as well as certain variations and modifications of the embodiments herein shown and described will obviously occur to those skilled in the art upon becoming familiar with said underlying concept.

I claim:

1. A motorized roller disc for multi-directional operation under the control of a user comprising:

a platform;

a plurality of perimeter wheel assemblies mounted around the underside perimeter of said platform, each perimeter wheel assembly further comprising, a first yoke fixedly attached to said platform, and a perimeter wheel rotationally attached to said yoke, said perimeter wheel being radially aligned with respect to a center of said platform;

a central pivot wheel assembly mounted at the center of the underside of said platform, said central pivot wheel assembly protruding slightly further than said perimeter wheel assembly, said central pivot wheel assembly comprising:

a second yoke rotationally mounted to said platform, and a center wheel rotationally attached to said second yoke;

a motor;

a first drive train coupled between said motor and one perimeter wheel of said plurality of perimeter wheel assemblies;

a second drive train coupled between the one perimeter wheel that is coupled with said first drive train and the remaining perimeter wheels of said plurality of perimeter wheel assemblies;

whereby a user maintains directional control of said motorized roller disk by weight shifting.

2. A motorized roller disc for multi-directional operation under the control of a user according to claim 1, further comprising a motor controller for controlling a speed of said motor.

3. A motorized roller disc for multi-directional operation under the control of a user according to claim 2, further comprising a hand-held speed controller connected to said motor controller for allowing said user to manually vary a speed of said motor.

4. A motorized roller disc for multi-directional operation under the control of a user according to claim 1, wherein said plurality of perimeter wheel assemblies are evenly-spaced around periphery of said platform and radially-oriented from the center of said platform at 36 degree offsets.

5. A motorized roller disc for multi-directional operation under the control of a user according to claim 4, wherein said perimeter wheels and said central wheel each further comprise a short axle segment fixedly attached to said hub, said short axle segment having distal ends, wherein said ends are carried in respective first or second yoke.

6. A motorized roller disc for multi-directional operation under the control of a user according to claim 5, wherein said second drive train is a flexible/jointed axle fixedly secured to said axle segments of said perimeter wheels in a circular configuration.

7. A motorized roller disc for multi-directional operation under the control of a user according to claim 1, further comprising a battery pack mounted directly to the underside of said platform for powering said motor.

8. A motorized roller disc for multi-directional operation under the control of a user according to claim 1, wherein said first drive train comprises a first pulley mounted to an axel of said motor, a second pulley mounted to said one perimeter wheel coupled to the first drive train, and a drive belt mounted to said first pulley on one end and to said second pulley on opposing end.

9. A motorized roller disc for multi-directional operation under the control of a user according to claim 1, wherein said central wheel and said perimeter wheels each comprise a roller mounted on a hub.

10. A motorized roller disc for multi-directional operation under the control of a user comprising:

a platform;

a plurality of perimeter wheel assemblies mounted around the underside perimeter of said platform, each perimeter wheel assembly comprising:

a first yoke fixedly attached to said platform, and a perimeter wheel rotationally attached to said yoke, said perimeter wheel is radially aligned with respect to the center of said platform;

a central pivot wheel assembly mounted at the center of the underside of said platform, said central pivot wheel assembly protruding slightly further than said perimeter wheel assembly, said central pivot wheel assembly comprising:

a second yoke rotationally mounted to said platform, and a center wheel rotationally attached to said second yoke;

a motor;

a hand-held speed controller for allowing a user to manually vary said motor speed; and a first drive train by which said motor rotatably engages one perimeter wheel of said plurality of perimeter wheel assemblies;

a second drive train by which said one perimeter wheel rotatably engaged with said motor rotatably engages the remaining perimeter wheels of said plurality of perimeter wheel assemblies for synchronous turning by said motor, said second drive train comprising a flexible/jointed axle connecting all of said perimeter wheels;

whereby said user controls the speed of the motor by said hand-held controller, and maintains directional control by weight shifting.

11. A motorized roller disc for multi-directional operation under the control of a user according to claim 10, wherein said central wheel and said perimeter wheels each comprise a roller mounted on a hub.

12. A motorized roller disc for multi-directional operation under the control of a user according to claim 11, wherein said perimeter wheels and said central wheel each further comprise a short axle segment fixedly mounted to said hub, said short axle segment having distal ends, wherein said ends are carried in respective first or second yoke.

13. A motorized roller disc for multi-directional operation under the control of a user according to claim 12, wherein said first yokes each comprise a two-flange mounting, each flange having a hole, whereby said distal ends of said axle segment pass through said holes.

14. A motorized roller disc for multi-directional operation under the control of a user according to claim 13, wherein said axle segment further comprises a hollow tubular segment.

15. A motorized roller disc for multi-directional operation under the control of a user according to claim 14, wherein said flexible/jointed axle of said second drive train is fixedly secured to said axle segments in a circular configuration.

16. A motorized roller disc for multi-directional operation under the control of a user according to claim 10, wherein said perimeter wheel assemblies are evenly-spaced around periphery of said platform and radially-oriented from the center of said platform at 36 degree offsets.

17. A motorized roller disc for multi-directional operation under the control of a user according to claim 10, further comprising a battery pack mounted directly to the underside of said platform.

18. A motorized roller disc for multi-directional operation under the control of a user according to claim 10, further comprising an on-board motor controller connected between said hand-held speed controller and said motor.

19. A roller disc for multi-directional operation under the control of a user comprising:

a platform;

a plurality of perimeter wheel assemblies mounted around the underside perimeter of said platform, each perimeter wheel assembly comprising:

a first yoke fixedly attached to said platform, and a perimeter wheel rotationally attached to said yoke, said perimeter wheel being radially aligned with respect to a center of said platform; and a central pivot wheel assembly mounted at the center of the underside of said platform, said central pivot wheel assembly protruding slightly further than said perimeter wheel assembly, said central pivot wheel assembly comprising:

a second yoke rotationally mounted to said platform, and a center wheel rotationally attached to said second yoke; and a transmission connecting all of said plurality of perimeter wheel assemblies for synchronous operation; and a motor for driving said transmission;

whereby said user controls the direction of said platform by weight shifting.

* * * * *